US007086893B2

(12) United States Patent
Liu et al.

(10) Patent No.: US 7,086,893 B2
(45) Date of Patent: Aug. 8, 2006

(54) ELECTRICAL CONNECTOR

(75) Inventors: Wolf Xing-Liang Liu, Kunsan (CN); Michael Ke-Zhi Li, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/144,926

(22) Filed: Jun. 3, 2005

(65) Prior Publication Data

US 2006/0052000 A1 Mar. 9, 2006

(30) Foreign Application Priority Data

Sep. 6, 2004 (TW) ..... 93214153 U

(51) Int. Cl.
*H01R 12/24* (2006.01)

(52) U.S. Cl. ..... 439/495; 439/260

(58) Field of Classification Search ..... 439/495, 439/260

See application file for complete search history.

(56) References Cited

U.S. PATENT DOCUMENTS 5,401,186 A 3/1995 Nozaki et al.
5,688,143 A 11/1997 McHugh et al.
6,280,240 B1 8/2001 Chang
6,319,033 B1 * 11/2001 Ma ..... 439/260
2002/0115327 A1 * 8/2002 Yamane ..... 439/260

FOREIGN PATENT DOCUMENTS

TW 532583 5/2003

* cited by examiner

*Primary Examiner*—Ross Gushi
(74) *Attorney, Agent, or Firm*—Wei Te Chung

(57) ABSTRACT

An electrical connector for connection with a flexible printed circuit (FPC) comprises an insulating housing defining an inserting direction; a plurality of electrical contacts; a pair of channels comprising a first groove and a second groove communicating each other and an actuator having a pair of stoppers extending from opposite sides thereof for facilitating movement of the actuator between a first position and a second position; when the actuator is in the first position, the stoppers are received in the first grooves, whereby the FPC is free to be inserted into the housing, and when the actuator is in the second position, the stoppers are received in the second grooves, whereby the actuator biases the FPC against the electrical contacts.

14 Claims, 9 Drawing Sheets

ELECTRICAL CONNECTOR

BACKGROUND OF THE INVENTION

1. Field of the Invention

The present invention is related to an electrical connector, and more particularly to an electrical connector used for a sheet-like connection member such as a flexible printed circuit or cable (FPC), a flexible flat cable (FFC) and so forth. All of these cables and circuit will be generally referred to as "FPC".

2. Description of Related Art

A variety of flexible printed circuits are widely used in electronic devices. Various electrical connectors are adapted for connecting corresponding flexible printed circuits. A conventional flexible printed circuit connector comprises an insulating housing, a plurality of electrical contacts received in the insulating housing and an actuator mounted movably on the insulating housing. The actuator moves between a closed position and an open position. When the actuator is in the open position, the flexible printed circuit can insert into the insulating housing freely, when the actuator is in the closed position, the actuator presses the flexible printed circuit so that the flexible printed circuit electrically connects with the electrical contacts.

However, when the actuator is in the closed position, the actuator easily overturns because of a resilient force produced by the electrical contacts, and at present the actuator of the connector is need to be flimsy with development of the flexible printed circuit connector. Problem produced because of the flimsy of the actuator is that the actuator is warped easily when the actuator is in the closed position, thus the flexible printed circuit can't connect with the electrical contacts reliably.

Referring to FIG. 1, Taiwan Pat. Issue No. 532583 discloses a flexible printed circuit connector 1 comprising an insulating housing 2, a plurality of electrical contacts 16 received in the housing 2 for electrically connecting with flexible printed circuit and an actuator 3 mounted movably on the housing 2. The housing 2 defines slots 14 for receiving the electrical contacts 16, a receiving chamber 18 for receiving flexible printed circuit and a pair of blocking slots 13 on opposite laterals of the housing 2. The actuator 3 comprises a pressing portion 32 and blocking portions 24 on opposite sides thereof. The blocking portions 24 comprise blocking arms 26 and the blocking arms 26 comprise first engaging portions 243 and second engaging portions 244. When the actuator is in the closed position, the pressing portion 32 is received in the receiving chamber 18 of the housing and the blocking arms 26 are inserted into the corresponding blocking slots 13 of the housing 2. The first engaging portions 243 and the second engaging portions 244 of the blocking arms 26 are engaging with protrusions (not shown) formed in the blocking slots 13 of the housing 2. Thus when the actuator 3 is in the closed position, the actuator 3 can't overturn and warp under a resilient force of the contacts 16.

However, when the actuator 3 moves to the open position from the closed position, the engaging portions 243, 244 of the blocking arms 26 are easily destroyed because of collision with the protrusions of the blocking slots 13 of the housing 2 and thus using life-span of the actuator 3 is decreased.

Hence, an improved flexible printed circuit connector is required to overcome the disadvantages of the prior art.

SUMMARY OF THE INVENTION

An object of the present invention is to provide an electrical connector which can secure a actuator in a closed position reliably and make the actuator back off from the closed position conveniently.

Accordingly, to achieve above-mentioned object, an electrical connector for connection with a flexible printed circuit (FPC) comprises an insulating housing comprising an inserting face and a receiving cavity for receiving the FPC, and defining an inserting direction of the FPC, a longitudinal direction perpendicular to the inserting direction and a vertical direction perpendicular to the inserting direction and the longitudinal direction; a plurality of electrical contacts received in the housing for electrically connecting with the FPC; a pair of guiding channels located at longitudinal opposites sides of the housing and each comprising a first groove and a second groove spaced from the first groove along the vertical direction and along the inserting direction respectively, and a guiding slope communicating the first groove and the second groove; and an actuator movably mounted on the housing for accomplishing an electrical connection of the electrical contacts and the FPC, and having a pair of stoppers extending from opposite sides thereof for facilitating movement of the actuator between a first position and a second position; wherein when the actuator is in the first position, the stoppers are received in the first grooves, whereby the FPC is free to be inserted into the housing, and when the actuator is in the second position, the stoppers are received in the second grooves, whereby the actuator biases the FPC against the electrical contacts.

The detailed features of the present invention will be apparent in the detailed description with appropriate reference to the accompanying drawings.

DETAILED DESCRIPTION OF THE INVENTION

Figure 1:
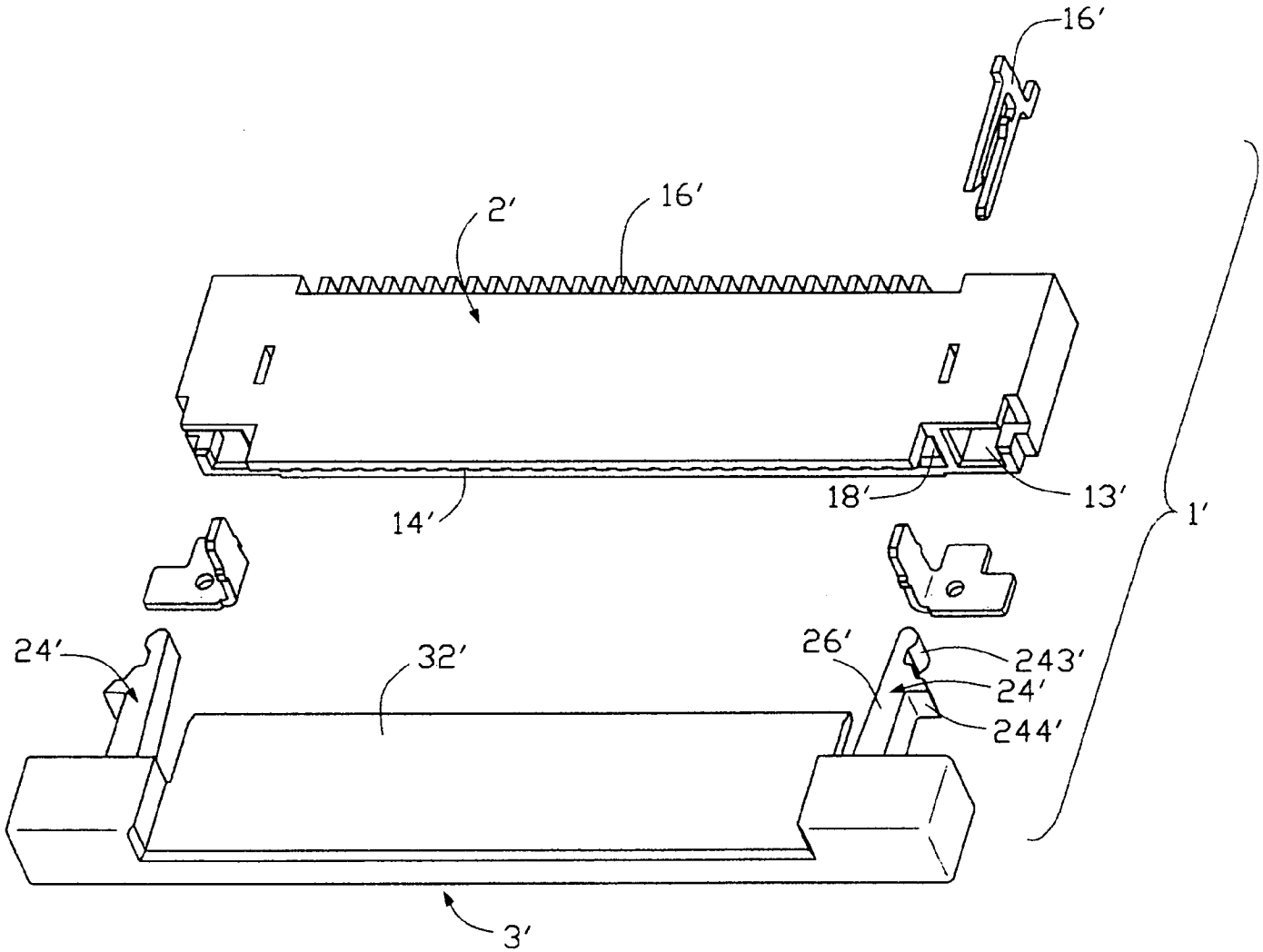
FIG. 1 (PRIOR ART)
FIG. 1 is a perspective view of a conventional electrical connector.
Figure 2:
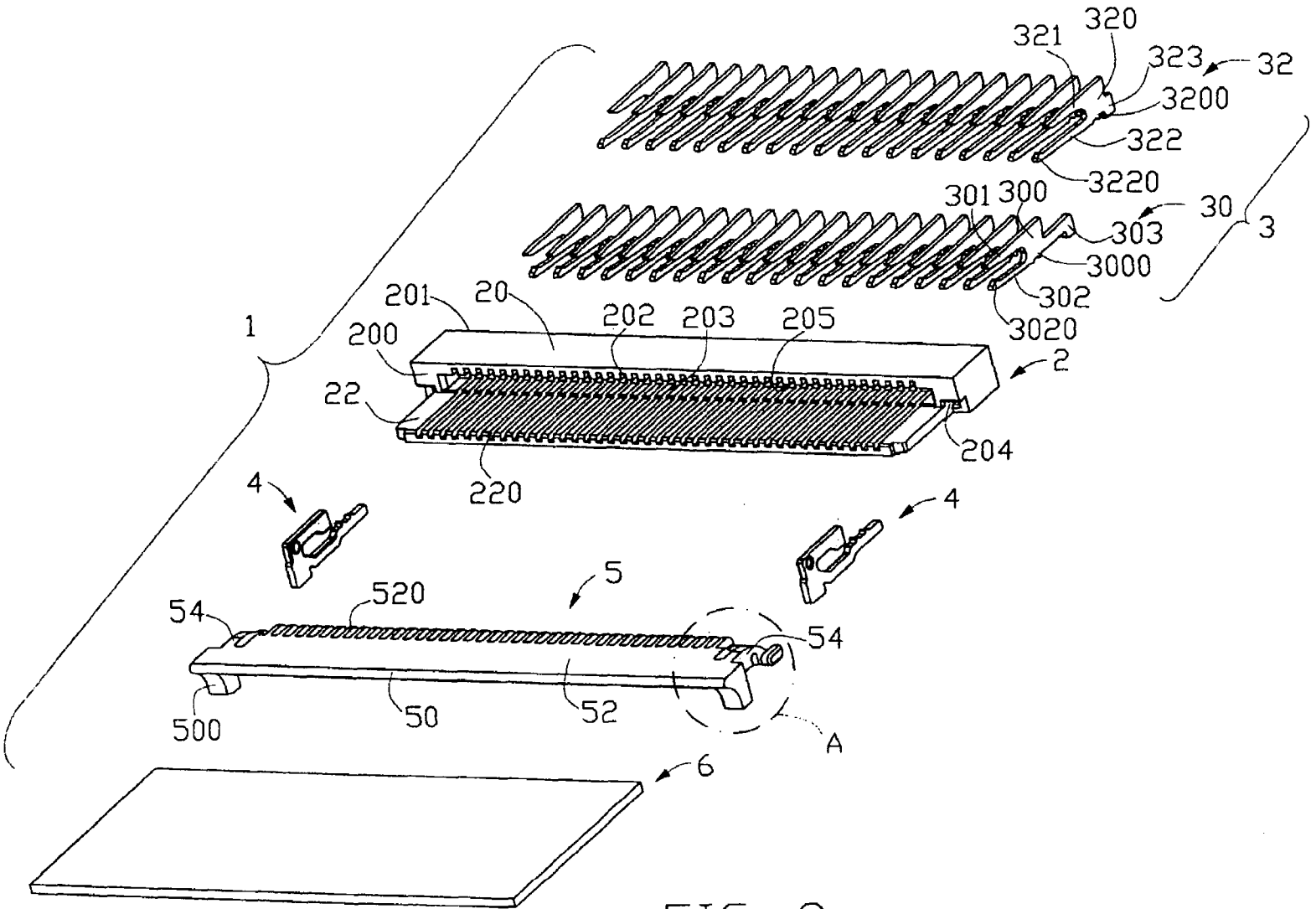
FIG. 2 is an exploded perspective view of an electrical connector in accordance with the present invention.

Referring to FIG. 2, an electrical connector 1 in accordance with the present invention is provided for electrically connecting a flexible printed circuit (FPC) 6. The electrical connector 1 comprises an insulating housing 2, a plurality of electrical contacts 3 received in the insulating housing 2, a pair of positioning members 4 and an actuator 5 engaging with the positioning members 4 for mounting movably on the insulating housing 2.

The insulating housing 2 comprises a receiving portion 20 being approximately rectangular and a mating portion 22 extending perpendicularly from the receiving portion 20. The receiving portion 20 comprises a front face 200 served as an inserting face, a rear face 201 opposite to the front face 200, a plurality of up receiving slots 202, a plurality of down receiving slots 203 and a pair of positioning slots 204 formed on opposite sides of the receiving portion 20 and extending along an inserting direction through the front face 200 and the rear face 201 for the FPC 6 insertion and the housing 2 defines a longitudinal direction perpendicular to the inserting direction and a vertical direction perpendicular to the inserting direction and the longitudinal direction. The up receiving slots 202 and the down receiving slots 203 also extend the inserting direction through the front face 200 and the rear face 201 and arranged in opposition to each other within the receiving portion 20. The receiving portion 20 is provided with a receiving cavity 205 between the up receiving slots 202 and the down receiving slots 203. The mating portion 22 comprises a plurality of grooves 220 communicating with the corresponding down receiving slots 203 and the grooves 220 and the down receiving slots 203 are served as a down receiving passage (not labeled), the up receiving slots 202 is served as a up receiving passage (not labeled), the down receiving passage and the up receiving passage make up of a receiving passage (not labeled) for receiving the electrical contacts 3.

The electrical contacts 3 comprises a plurality of first contacts 30 and a plurality of second contacts 31, and the first contacts 30 and the second contacts 31 are arranged alternately.

Each of the first contacts 30 comprises a first fixing portion 300, a first soldering portion 303 extending from one side of the first fixing portion 300 for soldering on a printed circuit board, a first supporting arm 301 and a first contacting arm 302 bifurcated from an opposite side of the first fixing portion 300. The first contacts 30 are inserted into the housing 2 from the rear face 201 thereof. The first supporting arm 301 is secured in the up receiving passage and the first contacting arm 302 is secured in the down receiving passage. The first fixing portion 300 defines a plurality of first barbs 3000 engaging with corresponding portions (not labeled) of the receiving passage to secure the first contacts 30 in the housing 2 reliably. The contacting arm 302 is formed with a first contacting portion 3020 to electrical connect with a corresponding electrical portion (not labeled) of the flexible printed circuit (FPC) 6.

Each of the second contacts 32 comprises a second fixing portion 320, a second soldering portion 323 extending from one side of the second fixing portion 320 for soldering on a printed circuit board and being shorter than the first soldering portion 303, a second supporting arm 321 and a second contacting arm 322 bifurcated from an opposite side of the second fixing portion 320. The first contacts 32 are inserted into the housing 2 from the rear face 201 thereof. The first supporting arm 321 is secured in the up receiving passage and the first contacting arm 322 is secured in the down receiving passage. The second contacting arm 322 is longer than the first contacting arm 302 of the first contact 30 and the first soldering portion 303 is longer than the second soldering portion 323. The second fixing portion 320 defines a plurality of second barbs 3200 engaging with corresponding portions (not labeled) of the receiving passage to secured the second contacts 32 in the housing 2 reliably. The contacting arm 322 is formed with a second contacting portion 3220 to electrical connect with a corresponding electrical portion (not labeled) of the flexible printed circuit (FPC) 6.

Figure 5:
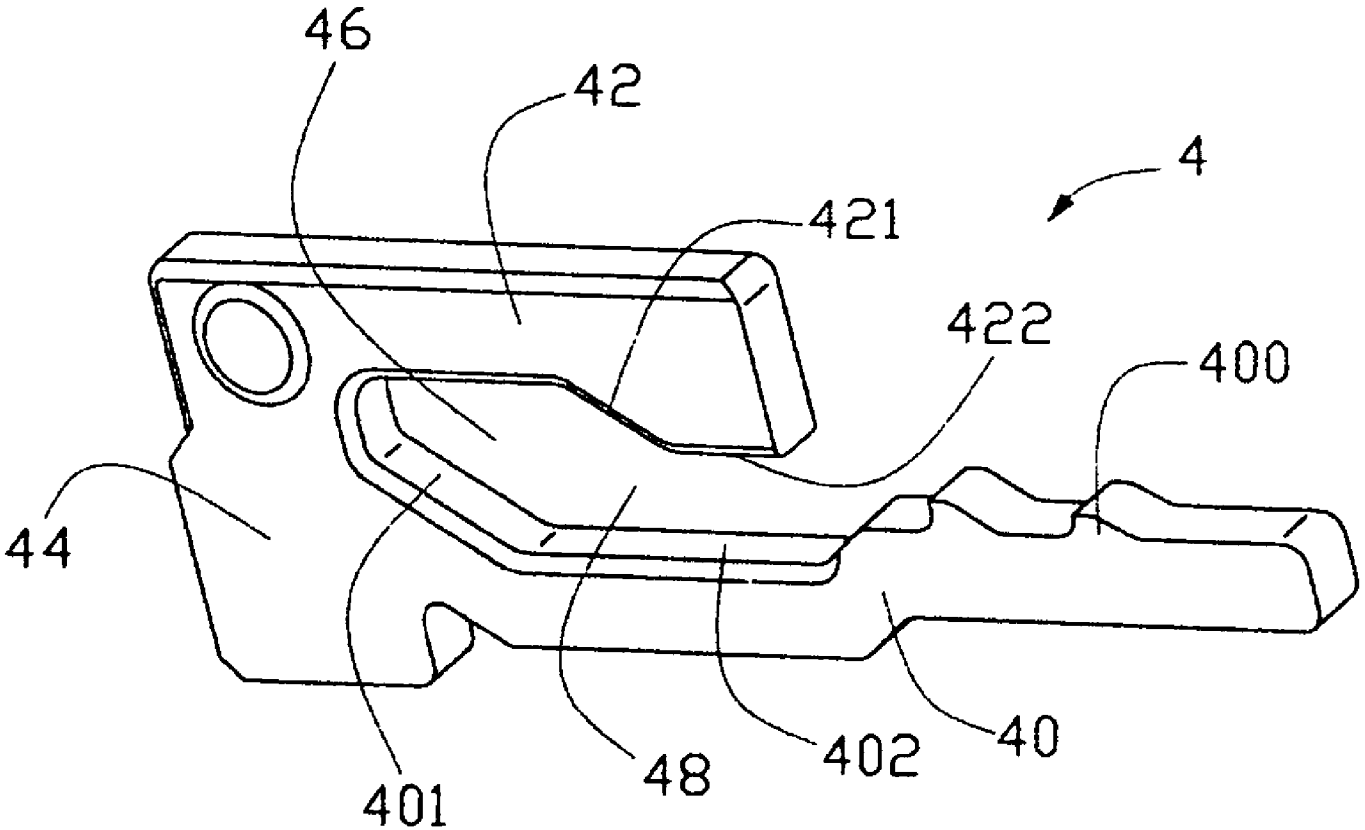
FIG. 5 is a perspective view of a positioning member of the electrical connector shown in FIG. 2.

Referring to FIG. 5, the positioning members 4 are mounted in the positioning slots 204 located at the longitudinal opposite sides of the housing 2. Each of the positioning members 4 comprises a locking arm 40, a colliding arm 42 extending parallel and opposite to the locking arm 40 and a connecting arm 44 connecting the locking arm 40 and the colliding arm 42. The locking arm 40 defines a plurality of barbs 400 on a free end thereof for engaging with a corresponding portion (not labeled) of the positioning slot 204 to secure the positioning member 4 in the housing 2 reliably. The positioning member 4 is provided with a guiding channel comprising an open groove 46 defined as a first groove and a closed groove 48 defined as a second groove between the locking arm 40 and the colliding arm 42 thereof. The closed groove 48 communicates with the open groove 46 and the closed groove 48 is located behind the open groove 46 along the inserting direction and the open groove 46 defines a first guiding slope 401 and a second guiding slope 421 on the locking arm 40 and the colliding arm 42 respectively and the first guiding slope 401 and the second guiding slope 421 both bias downwardly from the open groove 46 to the closed groove 48 along the vertical direction perpendicular to the inserting direction, that is to say, the open groove 46 is located above the closed groove 48. The actuator 5 can slide from an open position defined as a first position to a closed position defined as a second position along the first guiding slope 401 and the second guiding slope 421. The closed groove 48 defines a first colliding face 402 and a second colliding face 422 on the locking arm 40 and the colliding arm 42 respectively.

Figure 3:
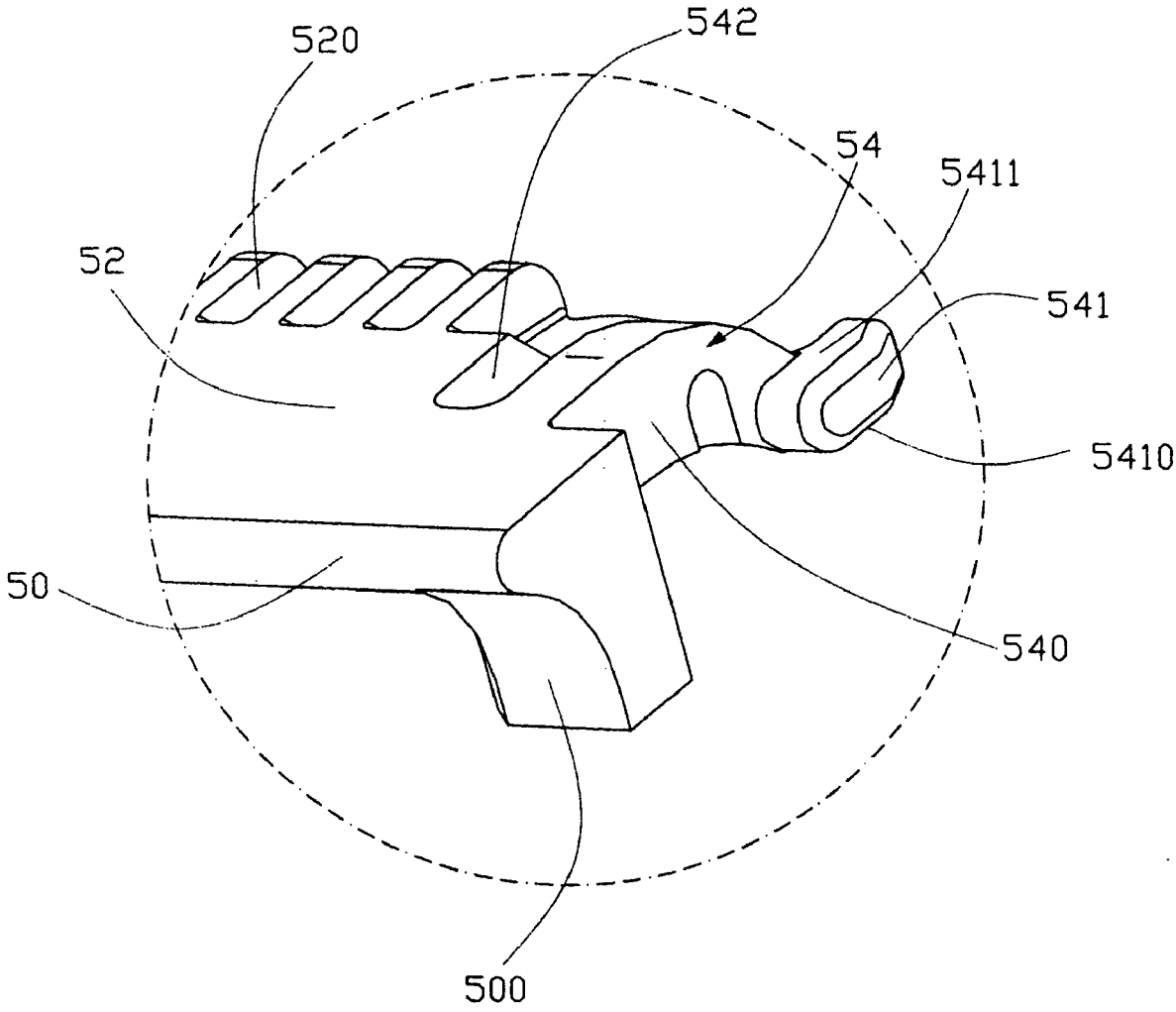
FIG. 3 is an enlarged perspective view of the electrical connector showing part A shown in FIG. 2.
Figure 4:
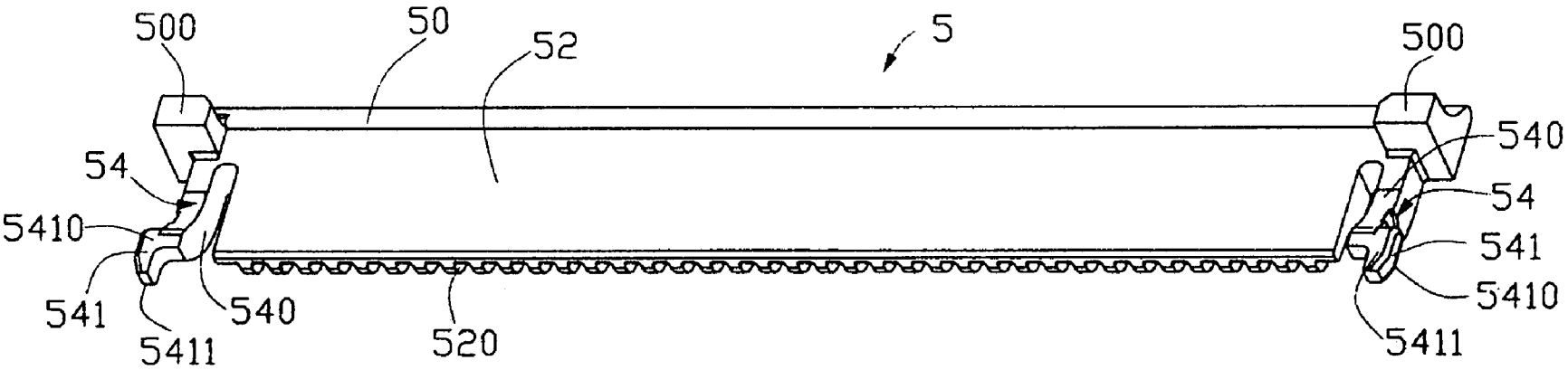
FIG. 4 is a rear perspective view of an actuator of the electrical connector shown in FIG. 2.

Referring to FIGS. 3 and 4, the actuator 5 comprises a plate 50 being approximately rectangular, an engaging portion 52 inserted into the receiving cavity 205 of the housing 2 and a pair of stoppers 54 formed on longitudinal opposite sides of the plate 50. A pair of blocking portions 500 extend downwardly from opposite sides of the plate 50. The engaging portion 52 defines a plurality of separating slots 520 on it's end portion corresponding the first supporting arms 301 of the first contacts 30 and the second supporting arms 321 of the second contacts 32 respectively. Each of the stoppers 54 comprises a holding arm 540 and a cam or boss 541 extending outwardly from a free end of the holding arm 540. A space 542 is defined between the holding arm 540 and the engaging portion 52 to increase elasticity of the holding arm 540. The cam 541 can receive in the open groove 46 and the closed groove 48 and defines a third colliding face 5410 and a fourth colliding face 5411. When the cam 541 disposes in the open groove 46, the actuator 5 is in the open position and moves freely therein driven by an outer force, and when the cam 541 moves into the closed groove 48 from the open groove 46 driven by the outer face, the actuator 5 is in the closed position and the third colliding face 5410 and the fourth colliding face 5411 of the cam 541 abut against the first colliding face 402 and the second colliding face 422 of the positioning member 4 respectively.

Figure 6:
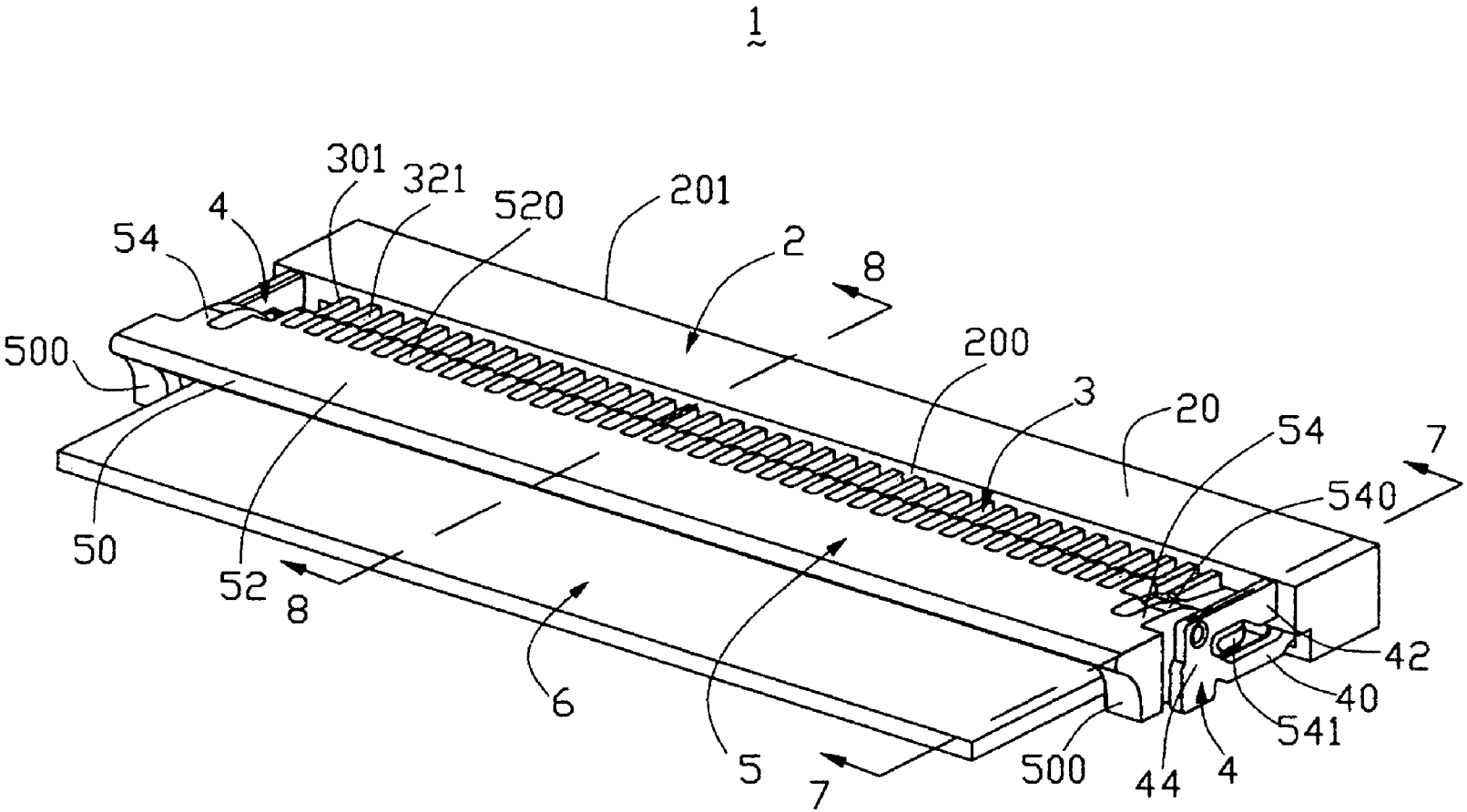
FIG. 6 is an assembled perspective view of the electrical connector showing the actuator is set in an open position.
Figure 7:
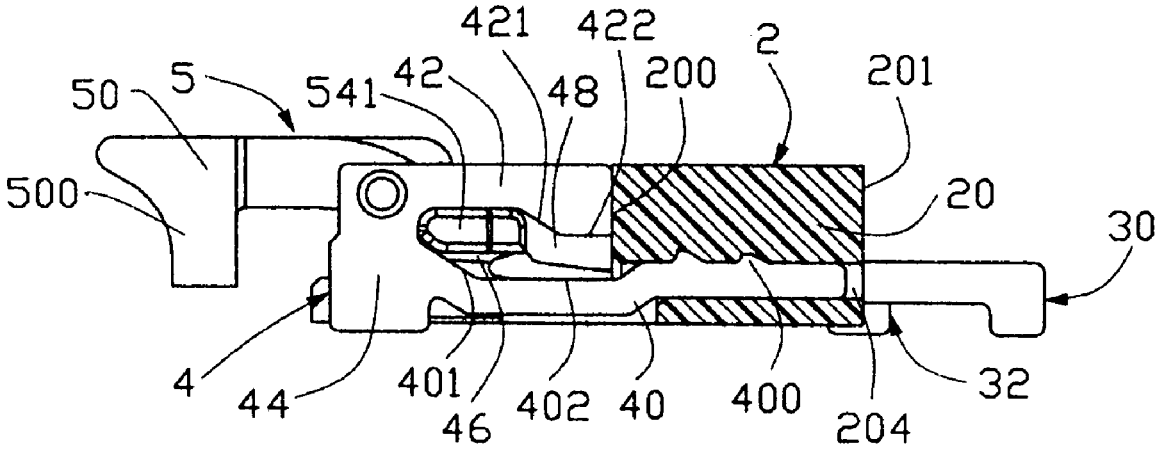
FIG. 7 is a cross-sectional view taken along line 7—7 shown in FIG. 6, not showing flexible printed circuit of the electrical connector.
Figure 8:
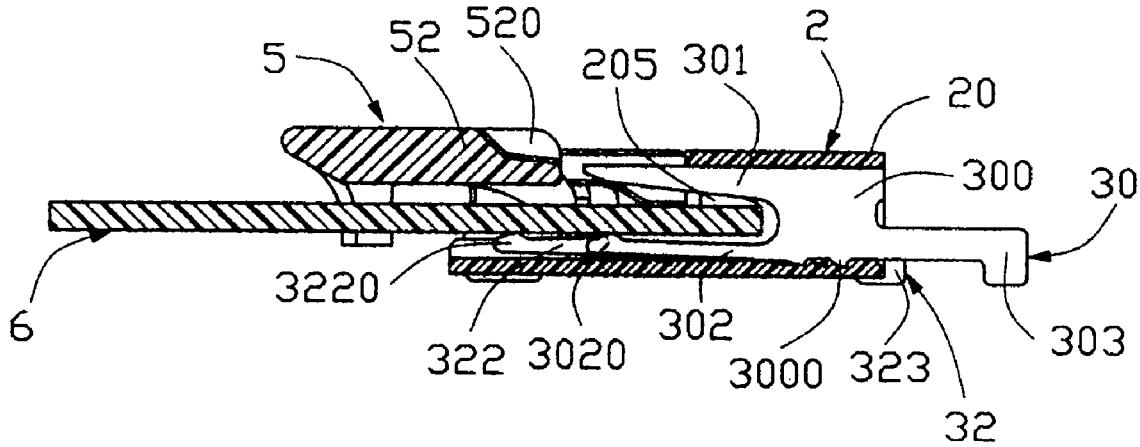
FIG. 8 is a cross-sectional view taken along line 8—8 shown in FIG. 6 of the electrical connector.

Referring to FIGS. 2 and 6, the first contacts 30 and the second contacts 32 are inserted into the receiving passage of the housing 2 from the rear face 201 and arranged alternately thereof, the positioning members 4 are inserted into the receiving portion 20 of the housing 2 from the front face 200 with the locking arm 40 being inserted into the corresponding positioning slot 204 thereof, the cam 541 of the stopper 54 of the actuator 5 is disposed in the open groove 46 of the positioning members 4. In conjunction with FIG. 7, the barbs 400 of the locking arm 40 are engaging with the corresponding portion (not labeled) of the positioning slot 204 of the housing 2 to secure the positioning member 4 in the housing 2 reliably, the end of the colliding arm 42 is colliding with the front face 200 of the receiving portion 20 of the housing 2 and the actuator 5 can slide to the closed groove 48 along the first guiding slope 401 and the second guiding slope 421 driven by the outer force. In conjunction with FIG. 8, the first supporting arm 301 of the first contact 30 and the second supporting arm 321 of the second contact 32 are received in the corresponding up receiving passage, the first contacting arm 302 and the second contacting arm 322 thereof are received in the corresponding down receiving passage and the first soldering portion 303 and the second soldering 323 are located outside the housing 2 to connect with printed circuit board. However, free ends of the first supporting arm 301 of the first contact 30 and the second supporting arm 321 of the second contact 32 aren't disposed in the corresponding separating slots 520 of the engaging portion 52 of the actuator 5, the engaging portion 52 and the mating portion 22 of the housing 2 spaced each other, thus the flexible printed circuit 6 can insert into the receiving cavity 205 of the housing 2 freely.

Figure 9:
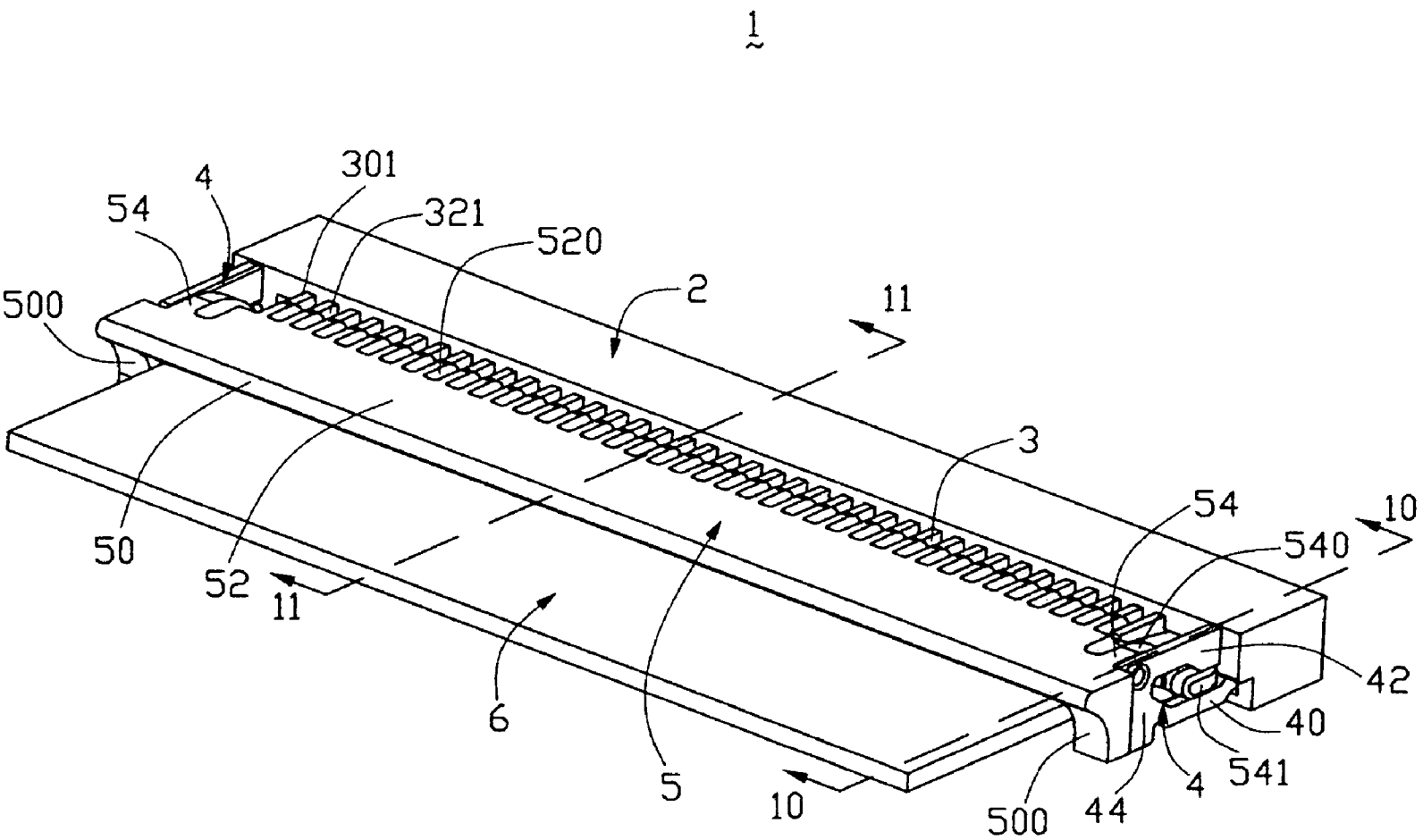
FIG. 9 is an assembled perspective view of the electrical connector showing the actuator is set in a closed position.
Figure 10:
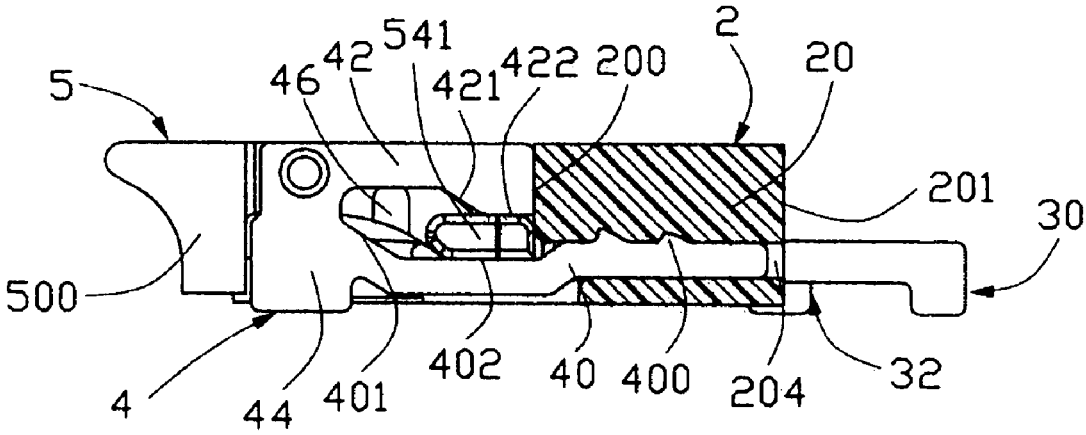
FIG. 10 is a cross-sectional view taken along line 10—10 shown in FIG. 9, not showing flexible printed circuit of the electrical connector.
Figure 11:
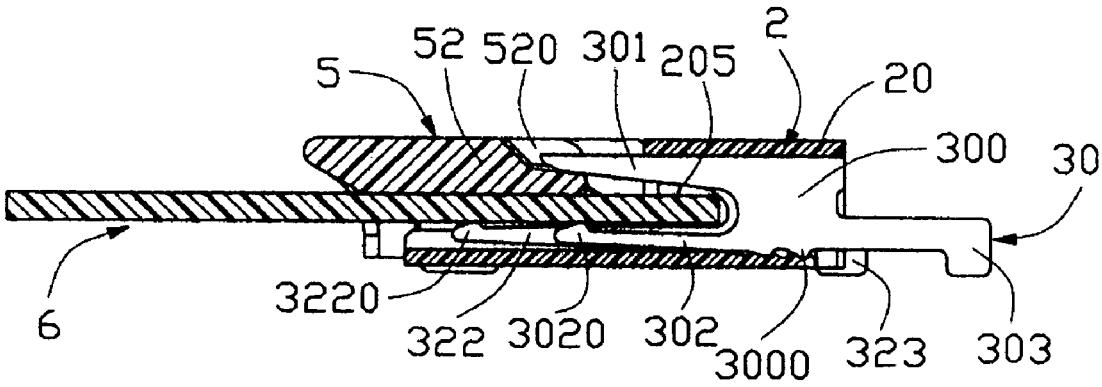
FIG. 11 is a cross-sectional view taken along line 11—11 shown in FIG. 9 of the electrical connector.

Referring to FIG. 9, the actuator 5 is in the closed position, the cam 541 of the stopper 54 is disposed in the closed groove 48 and abuts against the front face 200 of the mating portion 20 of the housing 2. In conjunction with FIGS. 3 and 10, the third colliding face 5410 and the fourth colliding face 5411 of the cam 54 abut against the first colliding face 402 and the second colliding face 422 of the positioning member 4 respectively. In conjunction with FIG. 11, the free ends of the first supporting arm 301 of the first contact 30 and the second supporting arm 321 of the second contact 32 are received in the corresponding separating slots 520 of the engaging portion 52 of the actuator 5, producing a down pressing force on the engaging portion 52. Thus the engaging portion 52 of the actuator biases the flexible printed circuit 6 because of the down pressing force thereon to make it electrically connect with the first contacting portions 3020 of the first contacts 30 and the second contacting portions 3220 of the second contacts 32. Because the third colliding face 5410 and the fourth colliding face 5411 of the cam 54 abut against the first colliding face 402 and the second colliding face 422 of the positioning member 4, the actuator 5 is self-locking between the first colliding face 402 and the second colliding face 422 of the positioning member 4, thus not overturning under elasticity of the contacts 3.

When the actuator 5 is needed to move to the open position from the closed position, an opposite outer force is befallen on the actuator 5, and the cam 541 moves into the open groove 46 from the closed groove 48 along the first and second guiding slope 401, 402 of the positioning member 4, preventing the cam 541 from destroying and increasing using life-span of the actuator 5.

The disclosure is illustrative only, changes maybe made in detail, especially in matter of shape, size, and arrangement of parts within the principles of the invention. For example, it would be doable that the contacts 3 are all same structure and the positioning members 4 and the housing are integrative.

What is claimed is:

1. An electrical connector for connection with a flexible printed circuit (FPC), comprising:

an insulating housing comprising an inserting face and a receiving cavity for receiving the FPC, and defining an inserting direction of the FPC, a longitudinal direction perpendicular to the inserting direction and a vertical direction perpendicular to the inserting direction and the longitudinal direction;

a plurality of electrical contacts received in the housing for electrically connecting with the FPC;

a pair of guiding channels located at longitudinal opposite sides of the housing and each comprising a first groove and a second groove spaced from the first groove along the vertical direction and along the inserting direction respectively, and a guiding slope communicating the first groove and the second groove; and an actuator movably mounted on the housing for accomplishing an electrical connection of the electrical contacts and the FPC, and having a pair of stoppers extending from opposite sides thereof for facilitating movement of the actuator between a first position and a second position; wherein when the actuator is in the first position, the stoppers are received in the first grooves, whereby the FPC is free to be inserted into the housing, and when the actuator is in the second position, the stoppers are received in the second grooves, whereby the actuator biases the FPC against the electrical contacts; wherein the electrical connector comprises a pair of positioning members and the pair of guiding channels are formed on the pair of positioning members.

2. The electrical connector as described in claim 1, wherein each of the positioning member comprises a locking arm secured in the housing and a colliding arm extending parallel and opposite the locking arm and abutting against the housing.

3. The electrical connector as described in claim 1, wherein each of the stoppers comprises a cam extending from a free end thereof and the cam is slidably received in the first groove and the second groove.

4. The electrical connector as described in claim 3, wherein the second grooves comprise colliding faces and the cams comprise colliding faces for abutting against colliding faces of the second grooves.

5. The electrical connector as described in claim 3, wherein each of the stopper is provided with a holding arm extending from opposite sides of the actuator and the cam extends from a free end of the holding arm.

6. The electrical connector as described in claim 1, wherein the electrical contacts comprise a plurality of first contacts and a plurality of second contacts arranged in the housing alternately.

7. The electrical connector as described in claim 6, wherein the actuator is provided with an engaging portion and the engaging portion is formed with separating slots, free ends of the first contacts and the second contacts are secured in separating slots of an engaging portion of the actuator when the actuator is in the second position.

8. The electrical connector as described in claim 1, wherein the electrical contacts comprises first contacts and second contacts.

9. The electrical connector as described in claim 8, wherein the first contacts comprise first soldering portions and the second contacts comprises second soldering portions, length of the first soldering portions extending beyond the housing is longer than that of the second soldering portions of the second contacts.

10. An electrical connector assembly comprising:

an insulative housing defining a receiving cavity therein;

a plurality of contacts disposed in the housing with contacting portions extending into the receiving cavity;

an actuator assembled to the housing;

a flexible printed circuit (FPC) removably inserted into the receiving cavity; and complementary interengaging devices formed around two opposite lengthwise ends of the housing and around two opposite lengthwise ends of the actuator so as to have the actuator move relative to the housing in essentially a translation manner for depressing the FPC against the corresponding contacting portions or releasing said FPC from the housing, wherein said translation manner is defined by a front-to-back direction along which the PPC is inserted into the housing, and a vertical direction perpendicular to said front-to-back direction.

11. The connector assembly as claimed in claim 10, wherein said complementary interengaging devices include a pair of guiding channels formed around the housing and a pair of bosses formed on the actuator.

12. The connector assembly as claimed in claim 10, wherein each of said contacts further includes a supporting arm opposite to the contacting portion, and said actuator engages said support arm when said actuator is fully assembled into the receiving cavity.

13. The connector assembly as claimed in claim 10, further including a pair of members respectively located around said two opposite lengthwise ends of the housing, which prevent the actuator from being withdrawn from the housing.

14. The connector assembly as claimed in claim 13, wherein said complementary interengaging devices include a pair of guiding channels formed around the housing and a pair of bosses formed on the actuator, and said guiding channels are formed in said members, respectively.

* * * * *